US010597600B2

(12) United States Patent
Nagakari et al.

(10) Patent No.: US 10,597,600 B2
(45) Date of Patent: Mar. 24, 2020

(54) LUBRICATING OIL COMPOSITION

(71) Applicant: SHELL OIL COMPANY, Houston, TX (US)

(72) Inventors: Mitsuhiro Nagakari, Tokyo (JP); Hiroshi Kaneko, Tokyo (JP); Hiroyuki Tazaki, Kanagawa (JP)

(73) Assignee: SHELL OIL COMPANY, Houston, TX (US)

( * ) Notice: Subject to any disclaimer, the term of this patent is extended or adjusted under 35 U.S.C. 154(b) by 0 days.

(21) Appl. No.: 16/086,688

(22) PCT Filed: Mar. 22, 2017

(86) PCT No.: PCT/EP2017/056880

§ 371 (c)(1),
(2) Date: Sep. 20, 2018

(87) PCT Pub. No.: WO2017/162774

PCT Pub. Date: Sep. 28, 2017

(65) Prior Publication Data

US 2019/0119603 A1 Apr. 25, 2019

(30) Foreign Application Priority Data

Mar. 24, 2016 (JP) ..... 2016-060446

(51) Int. Cl.
*C10M 169/04* (2006.01)
*C10M 101/02* (2006.01)
*C10M 105/30* (2006.01)

(52) U.S. Cl.
CPC ..... *C10M 169/047* (2013.01); *C10M 101/02* (2013.01); *C10M 105/30* (2013.01); *C10M 2203/1006* (2013.01); *C10M 2205/173* (2013.01); *C10M 2207/262* (2013.01); *C10M 2219/044* (2013.01); *C10M 2223/045* (2013.01); *C10N 2210/02* (2013.01); *C10N 2230/02* (2013.01); *C10N 2230/06* (2013.01); *C10N 2230/28* (2013.01); *C10N 2230/52* (2013.01); *C10N 2240/08* (2013.01)

(58) Field of Classification Search
CPC combination set(s) only.
See application file for complete search history.

(56) References Cited

U.S. PATENT DOCUMENTS

2003/0171228 A1* 9/2003 Deckman ..... C10M 163/00 508/460
2006/0281645 A1* 12/2006 Bell ..... C10M 159/22 508/460
2007/0298990 A1* 12/2007 Carey ..... C10M 111/04 508/591
2008/0256849 A1* 10/2008 Kulinowski ..... C10L 10/14 44/348
2012/0135904 A1* 5/2012 Kamano ..... C10M 135/10 508/548

FOREIGN PATENT DOCUMENTS

EP 0098281 A1 1/1984
EP 1985686 A1 10/2008
EP 2444474 A1 4/2012
EP 2650348 A1 10/2013
JP 2001234187 A 8/2001

OTHER PUBLICATIONS

International Search Report and Written Opinion received for PCT Patent Application No. PCT/EP2017/056880, dated Jun. 12, 2017, 10 pages.
"Electrostatic Flows of Liquids in Narrow Pipes", Aichi Industrial College Research Reports B Specialist Discussion Papers, vol. 14, Mar. 31, 1979, pp. 1-6.

* cited by examiner

*Primary Examiner* — Ellen M McAvoy
*Assistant Examiner* — Chantel L Graham

(57) ABSTRACT

A composition whereby a hydrocarbon-based base oil is used and in this base oil are incorporated, in terms of the total amount of the composition, 30 to 300 ppm of overbased calcium salicylate and, in net weight in terms of the total amount of the composition, 0.07 to 2.0 mass % of a non-dispersant polymethacrylate having a weight average molecular weight of 5000 to 200,000. The electrical conductivity at 25° C. of this composition is not less than 200 pS/m, the flash point is not less than 240° C., the pour point is −40° C. or lower and the micro clutch friction coefficient at 140° C. is not less than 0.08. This lubricating oil composition may be used in machines fitted with electronic control apparatus and can impart conductivity so as to inhibit the occurrence of "noise" which is detrimental to electronic control.

5 Claims, No Drawings

LUBRICATING OIL COMPOSITION

CROSS REFERENCE TO RELATED APPLICATIONS

This is a national stage application of International Application No. PCT/EP2017/056880, filed 22 Mar. 2017, which claims benefit of priority of Japanese application No. 2016-060446, filed 24 Mar. 2016.

FIELD OF THE INVENTION

This invention relates to a lubricating oil composition for use in hydraulically actuated machines and having electrical conductivity such that it does not give rise to misactuation or failure in electronic control apparatus such as electronically controlled valve systems.

BACKGROUND OF THE INVENTION

Mineral oils such as typical lubricating oils in which the main constituents are hydrocarbons are liquids which have good insulation. It has long been known that when such liquids are conveyed through pipes or the like, static electricity (which can be referred to as an electrostatic flow) occurs, as reported in Aichi Industrial College Research Reports B Specialist Discussion Papers 14, 1-6, "Electrostatic flows of liquids in narrow pipes" 31 Mar. 1979).

The electrical charge then created is carried to storage tanks together with the liquid, and there are cases where sparks occur inside the tanks or in the vicinity thereof because of the electrostatic charge or release of electricity and the liquid ignites. Known ways to suppress the accumulation of static electricity and to prevent sparking in relation to this phenomenon include, for example, adding Stadis-450 (made by the DuPont company) in which dinonylnaphthylsulphonic acid is the active constituent to increase electrical conductivity (or conductance or specific conductivity).

Furthermore, in recent years the risk of occurrence of static electricity has increased because of seeking higher performance from hydraulic apparatus and the higher speeds at which oils are conveyed. Sparks occurring because of electrostatic phenomena on the surfaces of solids or oils in such storage tanks manifest themselves as "noise", and give rise to problems in that they cause misactuation or failures in control apparatus which contains electronic parts.

In particular, hydraulic oils are liquids that transmit a motive force and are used in functions such as transmitting a motive drive, controlling power or acting as dampers in hydraulic systems such as hydraulic actuators and other apparatus. They also perform the function of lubricating sliding or rubbing parts.

The most recent hydraulic devices have kept on becoming more compact and delivering higher outputs. At the same time, where actuation pressures were once of the order of, say, 14 to 20 MPa, they have now gradually increased to over 30 MPa, and the rate at which the oil is conveyed has increased, so that the likelihood of an electrostatic flow occurring is even higher.

These hydraulic systems are normally fitted with electronically controlled valve systems, which means that not only are they designed to eliminate sparking "noise" but also that it is desirable that they have oils which, from the safety aspects during storage, have high flash points. In addition, there is demand for solutions that have suitable friction coefficients so that there are no control issues in the case of lubrication of wet brakes.

It is known that, in order to improve the conductivity of lubricating oil compositions, it is possible to incorporate in the base oils additives having in their molecules strong polar groups such as organometallic compounds, succinic acid derivatives or amine derivatives, and lipophilic groups of suitable size in combination with aromatic azo compounds. The qualifying standard for these is a volume resistivity of not more than $1\times10^{10}$ Ω·cm. This is of an order corresponding to at least 10 pS/m as a siemens (symbol S) rating and has still been insufficient to prevent reliably the occurrence of sparks due to electrostatic flow. Also, because aromatic azo compounds are a necessary ingredient, they give the lubricating oils a red colour and it has become difficult to evaluate the ageing of lubricating oils by means of visual inspection on site, so that there is then concern over braking or damping characteristics as indicated in Japanese Laid-open Patent 2001-234187.

This invention is intended to offer a lubricating oil composition for use in hydraulic actuators which imparts electrical conductivity in order to inhibit the occurrence of the "noise" which has a detrimental effect on electronic control mechanisms such as those that electronically control valve systems, and which also has superior braking properties for wet brakes controlled electronically, and which further has superior safety.

SUMMARY OF THE INVENTION

This invention uses a hydrocarbon-based base oil as the base oil, and the composition is such that this base oil contains 30 to 300 ppm as calcium content, in terms of the total amount of the composition, of overbased calcium salicylate and contains 0.07 to 2.0 mass % as net weight, in terms of the total amount of the composition, of a non-dispersant polymethacrylate the weight average molecular weight whereof is 5,000 to 200,000. The electrical conductivity of this composition at 25° C. is not less than 200 pS/m (S denotes siemens), and the flash point is not less than 240° C., the pour point is −40° C. or lower and the friction coefficient in a micro clutch test at 140° C. is not less than 0.08, so that it is a lubricating oil composition that can be used in hydraulically operated machines wherein electronic control apparatus is disposed.

Furthermore, the aforementioned base oil may included a GTL (gas-to-liquid) base oil, preferably so that it will comprise not less than 40 mass %.

This lubricating oil composition may also contain 100 to 1000 ppm as phosphorus content, in terms of the total amount of the composition, of a zinc dialkyldithiophosphate, so that the kinematic viscosity of said composition at 40° C. will be 10 to 100 $mm^2/s$.

DETAILED DESCRIPTION OF THE INVENTION

The lubricating oil composition of the invention makes it possible to increase electrical conductivity, makes it possible to inhibit the sparking that accompanies the electrostatic charge by lowering the pour point and minimising the electrostatic flow, and also makes it possible to use it safely because the flash point is high. It is thus possible to produce a lubricating oil composition for use in hydraulic actuators which suppresses the cause of the "noise" which has a detrimental effect on electronic control mechanisms such as those that electronically control valve systems, and which has superior braking properties for wet brakes controlled electronically.

The base oil used in this invention is a hydrocarbon-based base oil.

This hydrocarbon-based base oil is one that belongs to Group 1, Group 2, Group 3 or Group 4 of the API (American Petroleum Institute) base oil categories, and it may be one of these used alone or a mixture thereof.

As examples of the aforementioned Group 1 base oils, mention may be made of paraffinic mineral oils obtained by applying a suitable combination of refining processes such as solvent refining, hydrorefining and dewaxing to lubricating oil fractions obtained by atmospheric distillation of crude oil.

The Group 1 base oils used here should have a kinematic viscosity at 100° C. (as measured by ASTM D445 or JIS K2283 and likewise below) of 2 to 15 $mm^2/s$, but preferably 4 to 15 $mm^2/s$ and more preferably 6 to 11 $mm^2/s$. The viscosity index (as calculated by ASTM D2270 or JIS K2283 and likewise below) should be 90 to 120, but preferably 95 to 120 and more preferably 95 to 110. The sulphur content should be 0.03 to 0.7 mass %, but preferably 0.3 to 0.7 mass % and more preferably 0.4 to 0.7 mass %. The % CA in accordance with ASTM D3238 should be not more than 5, but preferably not more than 4 and more preferably not more than 3.4. The % CP should be not less than 60, but preferably not less than 63 and more preferably not less than 66.

As examples of Group 2 base oils, mention may be made of paraffinic mineral oils obtained by applying a suitable combination of refining processes such as hydrorefining and dewaxing to lubricating oil fractions obtained by atmospheric distillation of crude oil. Group 2 base oils refined by hydrorefining methods such as the Gulf Company method have a total sulphur content of less than 10 ppm and an aromatic content of not more than 5% and so are ideal for this invention.

There is no special restriction on the viscosity of these base oils, but the viscosity index should be 100 to 120. The kinematic viscosity at 100° C. should be 2 to 15 $mm^2/s$, but preferably 4 to 15 $mm^2/s$ and more preferably 6 to 11 $mm^2/s$. Also, the total sulphur content should be less than 0.03 mass % (300 ppm), but preferably less than 0.02 mass % (200 ppm) and more preferably less than 0.001 mass % (10 ppm). The total nitrogen content should be less than 10 ppm and preferably less than 1 ppm. In addition, oils with an aniline point (as measured by ASTM D611 or JIS K2256) of 80 to 150° C. but preferably 100 to 135° C. should be used.

It is also possible satisfactorily to use paraffinic mineral oils produced by high-level hydrorefining of lubricating oil fractions obtained by atmospheric distillation of crude oil, base oils refined by the Isodewaxing process which dewaxes and substitutes the wax produced by the dewaxing process with isoparaffins, and base oils refined by the Mobil wax isomerisation process.

These base oils correspond to API Group 2 and Group 3 base oils. There is no special restriction on the viscosity of these base oils, but the viscosity index should be 100 to 160 and preferably 100 to 145. The kinematic viscosity at 100° C. should preferably be 2 to 15 $mm^2/s$, more preferably 4 to 15 $mm^2/s$ and even more preferably 6 to 11 $mm^2/s$. Also, the total sulphur content should be 0 to 0.03 mass % (0 to 300 ppm) and preferably less than 0.01 mass % (100 ppm). The total nitrogen content should be less than 10 ppm and preferably less than 1 ppm. In addition, oils with an aniline point of 80 to 150° C. and preferably 110 to 135° C. should be used.

GTL (gas to liquid) base oils synthesised by the Fischer-Tropsch method of converting natural gas to liquid fuel have a very low sulphur content and aromatic content compared with mineral oil base oils refined from crude oil and have a very high paraffin constituent ratio, and so have excellent oxidative stability, and because they also have extremely small evaporation losses, they are ideal for use as base oils in this invention.

There is no special restriction on the viscosity characteristics of GTL base oils, but normally the viscosity index should be 100 to 180 and more preferably 100 to 150. Also, the kinematic viscosity at 100° C. should be 2 to 12 $mm^2/s$, but more preferably 2 to 9 $mm^2/s$.

Normally the total sulphur content should also be less than 0.03 mass % (300 ppm), but more preferably less than 10 ppm. The total nitrogen content will be less than 1 ppm. Such GTL base oils correspond to API Group 3 base oils, and as a commercial example mention may be made of Shell XHVI (registered trademark).

These GTL base oils may either form the complete content of the base oil or may be used as part of the total base oil. If used as part, they should be used as not less than 30 mass % of the total amount of the base oil, but preferably not less than 40 mass % and even more preferably not less than 50 mass %, in which case they can make the performance of the lubricating oil composition even more desirable.

As examples of hydrocarbon-based synthetic oils mention may be made of polyolefins, oligomers of ethylene and alpha-olefins, alkylbenzenes, alkylnaphthalenes, alkyldiphenylalkanes or mixtures thereof where the kinematic viscosity at 100° C. is 2 to 12 $mm^2/s$.

The aforementioned polyolefins include polymers of various olefins or hydrides thereof. Any olefin may be used, and as examples mention may be made of ethylene, propylene, butene and $\alpha$-olefins with five or more carbons. In the manufacture of the polyolefins, one kind of the aforementioned olefins may be used singly or two or more kinds may be used in combination.

Particularly suitable are the polyolefins or polybutenes which are polyolefins called polyalphaolefins (PAO) and which have a kinematic viscosity at 100° C. of 2 to 12 $mm^2/s$. These are base oils belonging to Group 4. These polyalphaolefins may also be mixtures of two or more kinds of synthetic oil.

Group 5 base oils include oxygen-containing ester and ether base oils and other synthetic oils, but these have a high density and so the absolute viscosity when they are used in a lubricating oil composition will rise and that will be a cause of pressure losses when they are used as hydraulic fluids. Looked at also from the standpoint of energy conservation, the use of Group 5 base oils as base oils for this invention should be avoided.

Of the aforementioned hydrocarbon-based base oils, those with a kinematic viscosity at 100° C. of less than 2 $mm^2/s$ will have a small molecular weight and so in general the flash point of the base oil (as measured by the COC method of JIS K2265-4) will be low at less than 150° C., and also the Noack (as measured by ASTM D5800) will be high and evaporation losses will become significant, which means that it is preferable not to use them for lubrication over long periods in bearings or for hydraulic actuation.

If the kinematic viscosity at 100° C. is more than 15 $mm^2/s$, the low-temperature viscosity of the lubricating oil composition (as measured by ASTM D5293 or ASTM D4684) will become high, which is not desirable for bearings rotating at high speeds or for hydraulic fluids.

If the % CA is greater than 5, or if the % CP is smaller than 60, the dissolving ability and polarity of the base oil will improve, but thermal and oxidative stability may fall, which is not desirable. Also, if the sulphur content is greater than 0.7 mass %, there will be a reduction in the thermal and oxidative stability of bearing oils and hydraulic fluids that will form the final composition, and the undesirable phenomenon of corrosion in respect of non-ferrous metals such as copper and aluminium alloys will be seen.

There is no special restriction on the amount of the aforementioned base oil to be incorporated in the lubricating oil composition, but, in terms of the total amount of the lubricating oil composition, it should be used in the range of 50 to 99 mass %, but preferably 60 to 99 mass % and more preferably 70 to 99 mass %.

Overbased metal salicylates are added to the aforementioned base oil. These overbased metal salicylates are known to be metallic detergents and dispersants, and the proportion of elemental metal contained, as a weight ratio, is preferably not less than 1% and not more than 10%, but more preferably not more than 8%.

As examples of the metal in the overbased metal salicylates, mention may be made of sodium and potassium in the case of alkali metals or calcium or magnesium in the case of alkaline earth metals. Of these, calcium and magnesium are preferred, and calcium is particularly preferred.

There is no special restriction on the amount of overbased metal salicylate incorporated, but, in terms of the total amount of the composition, not less than 30 ppm as calcium content is preferred, but more preferably not less than 50 ppm and yet more preferably not less than 70 ppm. The upper limit is preferably not more than 300 ppm, but more preferably not more than 250 ppm and yet more preferably not more than 200 ppm.

If the aforementioned content is less than 30 ppm, the requisite electrical conductivity may not be obtained, and if it exceeds 300 ppm, the friction coefficient characteristics will deteriorate, and so there will be a risk of causing poor braking in the case of wet brakes.

There is no special restriction on the structure of the aforementioned overbased metal salicylate, but it is preferable to use metallic salts of salicylic acid having alkyl groups of carbon number 1 to 30. But, of these, alkyl groups of carbon number 10 to 25 are preferred, and those of 10 to 20 are more preferred from the standpoint of improving conductivity and the friction coefficient.

What is meant by the aforementioned overbased salts are those where the base number of the metal salicylate is at least 150 mgKOH/g. This base number refers to the base number using the overbased oxygen method when measuring in accordance with "7. Potentiometric titration" of JIS K2501 "Petroleum products and lubricants—Determination of neutralisation number."

Poly(meth)acrylates can be added to the aforementioned base oil. These poly(meth)acrylates are known as viscosity index improvers, and as examples mention may be made of the so-called non-dispersant poly(meth)acrylates which are polymers or copolymers, or hydrogenates thereof, of one kind or two or more kinds of monomer selected from various kinds of (meth)acrylic acid esters.

The molecular weight of these poly(meth)acrylates is to be selected in consideration of their shear stability. Specifically, their weight average molecular weight, for example in the case of non-dispersant polymethacrylates, is normally 5,000 to 200,000, but preferably 10,000 to 50,000 and more preferably 30,000 to 40,000. The aforementioned poly(meth)acrylate may be freely selected and contain one kind or, in any amounts, two or more kinds of different molecular weights.

The aforementioned non-dispersant poly(meth)acrylates can be described as polymers or copolymers, or hydrides thereof, of one kind or two or more kinds of monomer selected from compounds that can be represented by the undermentioned general formula

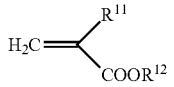

(1)

In the aforementioned general formula (1), $R^{11}$ denotes a hydrogen atom or a methyl group and R'2 denotes an alkyl group of carbon number 1 to 18. Specific examples of alkyl groups of carbon number 1 to 18 representing $R^{12}$ include a methyl group, ethyl group, propyl group, butyl group, pentyl group, hexyl group, heptyl group, octyl group, nonyl group, decyl group, undecyl group, dodecyl group, tridecyl group, tetradecyl group, pentadecyl group, hexadecyl group, heptadecyl group or octadecyl group, and these alkyl groups may be either straight-chain or branched.

As preferred specific examples of the constituent monomer of the aforementioned general formula (1), mention may be made of alkyl acrylates of carbon number 1 to 18, alkyl methacrylates of carbon number 1 to 18, olefins of carbon number 2 to 20, styrene, methylstyrene, maleic anhydride esters and mixtures thereof.

The aforementioned poly(meth)acrylates are normally presented diluted so as to be in liquid form, and the amount blended in the lubricating oil composition in that form, in terms of the total amount of the composition, is generally not less than 0.1 mass %, with an upper limit of not more than 10 mass %, but preferably not more than 8 mass % and more preferably not more than 5 mass %. If the amount incorporated, in terms of the total amount of the composition, is less than 0.1 mass %, it will be hard to obtain any effect in improving the conductivity, and if it exceeds 10 mass %, there is a possibility that the shear stability will deteriorate. The aforementioned blended amount in terms of net weight of poly(meth)acrylate will be 0.07 to 2.0 mass %.

It is possible to add also phosphorus compounds to the lubricating oil composition. By this means it is possible further to enhance the wear resistance. As examples of such phosphorus compounds, mention may be made of zinc dithiophosphates and zinc phosphates.

The amount incorporated of these phosphorus compounds, in terms of 100 parts by mass of the base oil, is of the order of 0.01 to 0.10 mass % (100 to 1000 ppm), and the amount of phosphorus, in terms of the total amount of the lubricating oil, will preferably be, by mass, in the range of 0.01% (100 ppm) to 0.08% (800 ppm), but more preferably 0.01 to 0.04 mass %, and they may be used singly or in combinations of plural kinds.

Since conductivity is low in the case of zinc dithiophosphates, exceeding an amount of 0.08 mass % for the blended amount of phosphorus will have a detrimental effect on conductivity, and if it is less than 0.01 mass % it may not be possible to maintain wear resistance.

As examples of the aforementioned zinc dithiophosphates, mention will normally be made of zinc dialkyldithiophosphates, zinc diaryldithiophosphates and zinc arylalkyldithiophosphates. As examples of the hydrocarbon groups, mention may be made in the case of alkyl groups of primary or secondary alkyl groups of carbon number 3 to 12, and in the case of aryl groups of phenyl groups or alkylaryl groups with phenyl groups substituted with alkyl groups of carbon number 1 to 18. The preferred instances of these zinc dithiophosphates are zinc dialkyldithiophosphates having primary alkyl groups and the carbon number of the alkyl groups will be 3 to 12 but more preferably 3 to 8.

In order to enhance the performance of the lubricating oil composition of the invention further, it is possible to use in it as necessary, apart from the aforementioned constituents, various kinds of additives. As examples of such additives, mention may be made of ashless friction modifiers (for example, monoglycerides), pour point depressants, antioxidants, extreme pressure additives, oiliness improvers, metal deactivators, anti-wear agents, defoamers, viscosity index improvers, detergents, rust inhibitors, defoamers and other lubricating oil additives of the known art.

The present lubricating oil composition will, as mentioned above, be such as to have conductivity (electrical conductivity) at 25° C. of not less than 200 pS/m. If it is the case that it is less than 200 pS/m, the ability to earth accumulations of static electricity caused by electrostatic flow will be reduced, and it will not be possible effectively to prevent the problems due to static electricity.

As also mentioned above, the flash point of the lubricating oil composition here is not less than 240° C., but is more preferably not less than 250° C., which means that it can be handled safely. Since the pour point is −40° C. or lower, it can also satisfactorily withstand use in cold regions.

There is no special restriction on the viscosity of the lubricating oil composition, but the kinematic viscosity at 100° C. will preferably be 2 to 15 $mm^2/s$, preferably 4 to 15 $mm^2/s$, and more preferably 6 to 11 $mm^2/s$. The kinematic viscosity at 40° C. will be 10 to 100 $mm^2/s$, preferably 15 to 100 $mm^2/s$, more preferably 22 to 100 $mm^2/s$, and yet more preferably 41 to 75 $mm^2/s$.

The viscosity grade of the lubricating oil composition may be set at VG46 to VG68, and the best situation will be that if in particular it is used as a hydraulic fluid.

EXAMPLES

The invention is explained in more detail below by means of examples of embodiment and comparative examples, but the invention is in no way limited by these.

The following materials were provided to prepare the examples of embodiment and comparative examples.

Base Oil 1: Hydrocarbon-based base oil blend being a mixture of 50 mass % each of a GTL (40° C. kinematic viscosity 44.0 $mm^2/s$, viscosity index 143) and a base oil of API category Group 1 (40° C. kinematic viscosity 49.5 $mm^2/s$, viscosity index 103)

Base Oil 2: Hydrocarbon-based base oil blend being a mixture of 40 mass % of a GTL (40° C. kinematic viscosity 44.0 $mm^2/s$, viscosity index 143) and 60 mass % of a base oil of API category Group 1 (40° C. kinematic viscosity 49.5 $mm^2/s$, viscosity index 103)

Base Oil 3: Hydrocarbon-based base oil blend being a mixture of 30 mass % of a GTL (40° C. kinematic viscosity 44.0 $mm^2/s$, viscosity index 143) and 70 mass % of a base oil of API category Group 1 (40° C. kinematic viscosity 49.5 $mm^2/s$, viscosity index 103)

Overbased Ca salicylate: M7121 (made by Infineum) (characteristics: base number 255 mgKOH/g, amount of Ca 8%)

Neutral Ca sulphonate: NaSul1729 (made by King Industries) (characteristics: base number 0, amount of Ca 2.1%)

Overbased Ca sulphonate: Oloa247E (made by Oronite) (characteristics: base number 330 mgKOH/g, amount of Ca 12.75%)

PMA 1: Non-dispersant polymethacrylate; Viscoplex 8-200 (made by Evonik) (characteristics: polymer concentration 72.5%, weight average molecular weight 33,000)

PMA 2: Non-dispersant polymethacrylate; Aclube V815 (made by Sanyo Chemical Industries) (characteristics: polymer concentration 60-70%, weight average molecular weight 20,000)

PMA 3: Non-dispersant polymethacrylate; Aclube 504 (made by Sanyo Chemical Industries) (characteristics: polymer concentration 35-45%, weight average molecular weight 180,000)

The weight average molecular weights of PMA 1 to PMA 3 were measured in accordance with the following measurement conditions.

Method of measurement (GPC (gel permeation chromatography)

The weight average molecular weight was calculated by using JIS K7252-1 "Plastics, Determination of average molecular mass and molecular mass distribution of polymers using size-exclusion chromatography. Part 1: General principles."

Measuring apparatus: SIL20AHT made by Shimadzu Scientific Instruments

Columns used: Shodex LF604×2

Measurement temperature: 40° C.

The following examples of embodiment and comparative examples were prepared.

Inventive Example 1

To 99.75 mass % of the aforementioned base oil were added 0.05 mass % of overbased Ca salicylate and 20 mass % of PMA 1, and after thorough mixing the lubricating oil composition of Example of Embodiment 1 was obtained.

Inventive Examples 2 to 12

The lubricating oil compositions of Examples of Embodiment 2 to 12 were obtained by using the components specified in Table 1 and Table 2, otherwise in accordance with Example of Embodiment 1.

Comparative Examples 1 to 15

The lubricating oil compositions of Comparative Examples 1 to 15 were obtained by using the components specified in Tables 3 to 5, otherwise in accordance with Example of Embodiment 1.

Tests

The following tests were carried out as appropriate in order to ascertain the characteristics and performance of the aforementioned examples of embodiment and comparative examples.

The amount of Ca in the lubricating oil composition was measured in accordance with the Japanese Petroleum Institute standard JPI-5S-38-03 "Lubricating oils—Determination of added elements—Inductively coupled plasma emission spectroscopy method" and is shown in ppm.

The 40° C. kinematic viscosity ($mm^2/s$) was measured in accordance with JIS K2283.

All the examples of embodiment and comparative examples were made to be within the range (46.0±10%) $mm^2/s$.

The amount of polymer contained in the lubricating oil composition due to the PMA was calculated and expressed in mass %.

The conductivity was measured by using the conductivity test method specified in JIS K2276 "Petroleum products—Testing methods for aviation fuels, 18."

In order to eliminate the effect of values measured when sample temperatures were not stable, they were left to stand for at least 12 hours in a room kept at a constant temperature of 25° C., after which the calculations were made using a Model 1152 conductivity meter made by US company Emcee Electronics.

Measured values were expressed in siemens (S).

Evaluation criteria: Not less than 200 pS/m=Pass (O)

Less than 200 pS/m=Fail (X)

A micro clutch test was used to calculate the value for the friction coefficient at 140° C. using the micro clutch test rig specified in JCMAS (Japanese Construction Mechanisation Association Standard) P047 "Hydraulic fluids for construction machinery—Test methods for friction characteristics."

Evaluation criteria: Friction coefficient of not less than 0.08=Pass (O)

Friction coefficient less than 0.8=Fail (X)

The flash point measurements were repeated for a total of three times using samples from each of the examples of embodiment and comparative examples in accordance with the automatic Cleveland Open Cup method of JIS K2265-4, and the average value was rounded down with decimal values of 0.4 and up for 0.5.

Evaluation criteria: Flash point of not less than 240° C. or less=Pass (O)

Flash point below 240° C.=Fail (X)

The pour point was measured on the basis of JIS K2269.

Evaluation criteria: Pour point of −40° C. or less=Pass (O)

Pour point higher than −40° C.=Fail (X)

Results

The results of the aforementioned tests are shown in Tables 1 to 5.

Examples of Embodiment 1 to 5 had overbased Ca salicylate and PMA 1 blended with Base Oil 1, and so good results were obtained with passes for all of electrical conductivity, micro clutch friction coefficient, flash point and pour point.

In the case of Example of Embodiment 2, the amount of PMA 1 added was made 10 times that of Example of Embodiment 1, and the conductivity improved further compared with Example of Embodiment 1. In Example of Embodiment 3, the amount of overbased Ca salicylate added was made twice that of Example of Embodiment 1, and the conductivity improved compared with Example of Embodiment 1. In the case of Examples of Embodiment 4 and 5, the amount of PMA 1 added was made 5 and 10 times that of Example of Embodiment 3, and the conductivity improved further.

In Examples of Embodiment 6 and 7, overbased Ca salicylate and PMA 2 were blended with Base Oil 2, and in both cases there were Passes for conductivity, micro clutch friction coefficient, flash point and pour point, so that good results were obtained. Comparative Example 6 improved conductivity more than Example of Embodiment 3 because of the difference in PMA used. When the amount of PMA 2 added was increased as in Example of Embodiment 7, even more desirable results than for Example of Embodiment 4 were obtained.

Examples of Embodiment 8 and 9 used PMA 3 and the conductivity obtained was intermediate between Examples of Embodiment 3 and 4 and Examples of Embodiment 6 and 7, but the results were good.

In the case of Example of Embodiment 10, the amount of overbased Ca salicylate was increased, and the conductivity accordingly improved compared with Example of Embodiment 3. Example of Embodiment 11 used Base Oil 2 rather than the Base Oil 1 of Example of Embodiment 4, and it was evident that almost the same desirable results as for Example of Embodiment 4 were obtained. Example of Embodiment 12 used Base Oil 3 rather than the Base Oil 1 of Example of Embodiment 4, and the flash point was a little lower, but it was evident that almost the same desirable results as for Example of Embodiment 4 had been obtained in this case, too.

In contrast, Comparative Example 1 was comprised of Base Oil 1 and Comparative Example was Base Oil 1 to which only PMA 1 had been added, Comparative Example 3 had only PMA 2 added and Comparative Example 4 had only PMA 3 added. In all cases there was virtually no conductivity, which was not desirable.

Comparative Example 5 had only neutral Ca sulphonate added to Base Oil 1, and conductivity was low and pour point high, which was not desirable. Comparative Example 7 had only overbased Ca sulphonate added to Base Oil land conductivity was improved compared with Comparative Example 5, but the pour point was high and so it had not yet reached a Pass level. Comparative Example 6 had PMA 1 added to Comparative Example 7 and the pour point passed, but the conductivity fell, which was not desirable.

Comparative Examples 1 to 7 failed in respect of either conductivity or pour point, and so no micro clutch test was carried out.

Comparative Example 8 had an increased amount of overbased Ca salicylate added to Base Oil 1, and the conductivity passed, but it failed on the micro clutch friction coefficient and pour point. Comparative Examples 9 and 10 each had PMA 1 added to Comparative Example 8 in varying amounts. Even when the amount of overbased Ca salicylate was large, the micro clutch friction coefficient was evaluated as a Fail despite the addition of the PMA, and so the desired results were not obtained.

Comparative Examples 11 to 13 had similar amounts of overbased Ca salicylate added to Base Oil 1 as in the examples of embodiment, but because no PMA had been added, Comparative Examples 11 and 12 failed on pour point and Comparative Example 13 failed on both conductivity and pour point.

Comparative Examples 14 and 15 used Base Oil 3 or Base Oil 2 instead of the Base Oil 1 of Comparative Example 11, and there were Passes on conductivity, micro clutch friction coefficient and flash point, but in the case of Comparative Example 14 there was a Fail on pour point, and Comparative Example 15 also failed on pour point, so it was evident that the desired results had not been obtained.

TABLE 1

| Inventive Examples 1 to 5 | | | | | |
|---|---|---|---|---|---|
| | 1 | 2 | 3 | 4 | 5 |
| Base Oil 1 | 99.75 | 97.95 | 99.70 | 98.90 | 97.90 |
| Base Oil 2 | | | | | |
| Base Oil 3 | | | | | |
| Overbased Ca salicylate | 0.05 | 0.05 | 0.10 | 0.10 | 0.10 |
| PMA 1 | 0.20 | 2.00 | 0.20 | 1.00 | 2.00 |
| PMA 2 | | | | | |
| PMA 3 | | | | | |
| Ca in oil (ppm) | 45 | 45 | 90 | 90 | 90 |
| Kinematic viscosity (40° C.) ($mm^2/s$) | 46.4 | 50.3 | 46.4 | 48.2 | 50.3 |
| Polymer amount (mass %) | 0.145 | 1.45 | 0.145 | 0.725 | 1.45 |
| Conductivity (25° C.) (pS) | 265 | 670 | 490 | 850 | 1380 |
| Micro clutch (140° C.) | 0.103 | 0.103 | 0.083 | 0.083 | 0.083 |
| Flash point (° C.) | 260 | 260 | 260 | 260 | 260 |
| Pour point (° C.) | −40.0 | −40.0 | −40.0 | −40.0 | −40.0 |

TABLE 2

| Inventive Examples 6 to 12 | | | | | | | |
|---|---|---|---|---|---|---|---|
| | 6 | 7 | 8 | 9 | 10 | 11 | 12 |
| Base Oil 1 | 99.70 | 98.90 | 99.70 | 98.90 | 99.69 | | |
| Base Oil 2 | | | | | | 98.90 | |
| Base Oil 3 | | | | | | | 98.90 |
| Overbased Ca salicylate | 0.10 | 0.10 | 0.10 | 0.10 | 0.12 | 0.10 | 0.10 |
| PMA 1 | | | | | 0.20 | 1.00 | 1.00 |
| PMA 2 | 0.20 | 1.00 | | | | | |
| PMA 3 | | | 0.20 | 1.00 | | | |
| Ca in oil (ppm) | 90 | 90 | 90 | 90 | 100 | 90 | 90 |
| Kinematic viscosity (40° C.) ($mm^2/s$) | 46.1 | 46.9 | 46.3 | 47.2 | 46.0 | 48.2 | 48.2 |
| Polymer amount (mass %) | 0.12-0.14 | 0.6-0.7 | 0.07-0.09 | 0.35-0.45 | 0.145 | 0.725 | 0.725 |
| Conductivity (25° C.) (pS) | 805 | >2000 | 535 | 1100 | 530 | 830 | 850 |
| Micro clutch (140° C.) | 0.083 | 0.083 | 0.083 | 0.083 | 0.083 | 0.083 | 0.083 |
| Flash point (° C.) | 260 | 260 | 260 | 260 | 260 | 250 | 240 |
| Pour point (° C.) | −40.0 | −40.0 | −40.0 | −40.0 | −40.0 | −40.0 | −40.0 |

TABLE 3

| Comparative Examples 1 to 4 | | | | |
|---|---|---|---|---|
| | Comp. Ex. 1 | Comp. Ex. 2 | Comp. Ex. 3 | Comp. Ex. 4 |
| Base Oil 1 | 100.00 | 98.00 | 98.00 | 98.00 |
| Base Oil 2 | | | | |
| Base Oil 3 | | | | |
| Overbased Ca salicylate | | | | |
| Neutral Ca sulphonate | | | | |
| Overbased Ca sulphonate | | | | |
| PMA 1 | | 2.00 | | |
| PMA 2 | | | 2.00 | |
| PMA 3 | | | | 2.00 |
| Ca in oil (ppm) | 0 | 0 | 0 | 0 |
| Kinematic viscosity (40° C.) ($mm^2/s$) | 46.0 | 50.3 | 41.8 | 48.4 |
| Polymer amount (mass %) | 0 | 1.45 | 1.2-1.4 | 0.7-0.9 |
| Conductivity (25° C.) (pS) | 3 | 3 | 3 | 3 |
| Micro clutch (140° C.) | — | — | — | — |
| Flash point (° C.) | 260 | 260 | 260 | 260 |
| Pour point (° C.) | −35.0 | −40.0 | −40.0 | −40.0 |

TABLE 4

| Comparative Examples 5 to 10 | | | | | | |
|---|---|---|---|---|---|---|
| | 5 | 6 | 7 | 8 | 9 | 10 |
| Base Oil 1 | 99.43 | 97.91 | 99.91 | 99.85 | 99.65 | 97.85 |
| Base Oil 2 | | | | | | |
| Base Oil 3 | | | | | | |
| Overbased Ca salicylate | | | | 0.15 | 0.15 | 0.15 |
| Neutral Ca sulphonate | 0.57 | | | | | |
| Overbased Ca sulphonate | | 0.094 | 0.094 | | | |
| PMA 1 | | 2.00 | | | 0.20 | 2.00 |
| PMA 2 | | | | | | |
| PMA 3 | | | | | | |
| Ca in oil (ppm) | 120 | 120 | 120 | 125 | 125 | 125 |
| Kinematic viscosity (40° C.) ($mm^2/s$) | 46.0 | 50.3 | 46.0 | 46.0 | 46.4 | 50.3 |
| Polymer amount (mass %) | 0 | 1.45 | 0 | 0 | 0.145 | 1.45 |
| Conductivity (25° C.) (pS) | 95 | 150 | 210 | 335 | 590 | 1640 |
| Micro clutch (140° C.) | — | — | — | 0.074 | 0.074 | 0.074 |
| Flash point (° C.) | 260 | 260 | 260 | 260 | 260 | 260 |
| Pour point (° C.) | −35.0 | −40.0 | −35.0 | −35.0 | −40.0 | −40.0 |

TABLE 5

| Comparative Examples 11 to 15 | | | | | |
|---|---|---|---|---|---|
| | 11 | 12 | 13 | 14 | 15 |
| Base Oil 1 | 99.90 | 99.89 | 99.95 | | |
| Base Oil 2 | | | | | 99.90 |
| Base Oil 3 | | | | 99.90 | |
| Overbased Ca salicylate | 0.10 | 0.12 | 0.05 | 0.10 | 0.10 |
| Neutral Ca sulphonate | | | | | |
| Overbased Ca sulphonate | | | | | |
| PMA 1 | | | | | |
| PMA 2 | | | | | |
| PMA 3 | | | | | |
| Ca in oil (ppm) | 90 | 100 | 45 | 90 | 90 |
| Kinematic viscosity (40° C.) ($mm^2/s$) | 46.0 | 46.0 | 46.0 | 46.0 | 46.0 |
| Polymer amount (mass %) | 0 | 0 | 0 | 0 | 0 |
| Conductivity (25° C.) (pS) | 250 | 280 | 105 | 250 | 250 |
| Micro clutch (140° C.) | 0.083 | 0.08 | 0.103 | 0.083 | 0.083 |
| Flash point (° C.) | 260 | 260 | 260 | 240 | 250 |
| Pour point (° C.) | −35.0 | −35.0 | −35.0 | −35.0 | −35.0 |

That which is claimed is:

1. A lubricating oil composition comprising a hydrocarbon-based base oil and, in terms of the total amount of the composition, 30 to 300 ppm of overbased calcium salicylate as well as, in net weight in terms of the total amount of the composition, 0.07 to 2.0 mass % of a non-dispersant polymethacrylate the weight average molecular weight whereof is 5000 to 200,000, the electrical conductivity at 25° C. of said composition is not less than 200 pS/m, the flash point is not less than 240° C., the pour point is 40° C. or lower and the friction coefficient at 140° C. (in a micro clutch test) is not less than 0.08.

2. The lubricating oil composition according to claim 1, wherein the hydrocarbon-based base oil contains a gas-to-liquid (GTL) base oil.

3. The lubricating oil composition according to claim 2, wherein the hydrocarbon-based base oil contains not less than 40 mass % of a gas-to-liquid (GTL) base oil.

4. The lubricating oil composition according to claim 1, wherein the viscosity grade of the composition is VG 46 to 68.

5. The lubricating oil composition according to claim 1, wherein the composition contains 100 to 1000 ppm of phosphorus of a zinc dialkyldithiophosphate and wherein the kinematic viscosity at 40° C. of said composition is 10 to 100 mm2/s.

* * * * *